US006176612B1

(12) United States Patent
Chagnoux

(10) Patent No.: US 6,176,612 B1
(45) Date of Patent: Jan. 23, 2001

(54) METHOD FOR ATTACHING A WATCHBAND TO A WATCH CASE

(75) Inventor: Gérard Chagnoux, Ferney Voltaire (FR)

(73) Assignee: Omega SA, Bienne (CH)

( * ) Notice: Under 35 U.S.C. 154(b), the term of this patent shall be extended for 0 days.

(21) Appl. No.: 09/341,841

(22) PCT Filed: Jan. 30, 1998

(86) PCT No.: PCT/CH98/00035

§ 371 Date: Jul. 19, 1999

§ 102(e) Date: Jul. 19, 1999

(87) PCT Pub. No.: WO98/34163

PCT Pub. Date: Aug. 6, 1998

(30) Foreign Application Priority Data

Jan. 31, 1997 (FR) ..... 97 01319

(51) Int. Cl.[7] ..... G04B 37/00
(52) U.S. Cl. ..... 368/282; 224/168; 224/169
(58) Field of Search ..... 368/281, 282; 224/168–180

(56) References Cited

U.S. PATENT DOCUMENTS 1,085,857 * 2/1914 Fitch ..... 368/282
2,028,791 * 1/1936 Lynds ..... 368/282
5,146,437 9/1992 Bourcheron ..... 368/282

FOREIGN PATENT DOCUMENTS 647 379 1/1985 (CH) .
0 052 316 5/1982 (EP) .
0 461 069 A1 12/1991 (EP) .
0 664 093 A1 7/1995 (EP) .
2 265 297 10/1975 (FR) .
2 278 286 2/1976 (FR) .

* cited by examiner

*Primary Examiner*—Bernard Roskoski
(74) *Attorney, Agent, or Firm*—Griffin & Szipl, P. C.

(57) ABSTRACT

The invention concerns a device for attaching a wristlet (1) to a watchcase including a middle part (2) fitted with a pair of attachment horns (2*e*) for the wristlet (1), this device allowing instantaneous attaching and detaching of a strand of the wristlet (1) to the middle part (2) without using a tool and without any particular knowledge or visual inspection, characterized in that one of the ends of the wristlet is attached to a plate (4) including two pairs of catches (1*a*, 1*b*, 1*c*, 1*d*) arranged respectively along the longitudinal edges of the plate (4), and co-operating with two pairs of grooves (2*a*, 2*b*, 2*c*, 2*d*) provided in lateral faces of the horns (2*e*).

20 Claims, 3 Drawing Sheets

METHOD FOR ATTACHING A WATCHBAND TO A WATCH CASE

The present invention concerns a device for attaching a bracelet or wristlet to a watchcase including a middle part fitted with a pair of horns for attaching the wristlet, and more particularly a device of this type allowing the wristlet to be interchanged simply, without using tools and without risking damaging the watchcase and/or the wristlet.

Generally, watch wristlets are fixed onto watchcases with horns by means of bars onto which the strands of the wristlet are attached, the ends of the bars being fixed to the horns of the watchcase. The most commonly used bars are called spring bars and include two pivots at their ends. The pivots are mobile within a central tube and are subjected to the action of a spring housed within the tube which pushes them outwards. The horns are respectively fitted with holes in which the bar pivots enter. Both horns are parallel to each other and generally spaced apart by 10 to 20 mm.

Such a system for attaching the wristlet to the case has the drawback of generally requiring the intervention of a specialist for detaching the wristlet when the latter has to be replaced by another one. Further, this detaching operation is performed with the aid of a tool, for example tweezers or a knife, which risks damaging the watchcase. This system is consequently not very satisfactory and does not meet current market requirements which demand wristlet attaching devices allowing users easily to replace their wristlet with another by themselves. One may also wish to adapt the type of wristwatch to the circumstances at any time of the day and thus to be able to change the wristlet easily oneself, for example to have a wristlet matching the colour of one's clothes.

A main object of the invention is thus to overcome the drawbacks of the aforementioned prior art by providing a secure and inexpensive device for rapidly attaching a watch wristlet, which can easily be implemented by the user himself, which fits any type of wristlet and which does not impair the aesthetic appearance of the watch.

The invention thus concerns a device for attaching a wristlet to a watchcase including a middle part comprising a pair of attachment horns for the wristlet, this device allowing instantaneous attaching and detaching of a wristlet strand to the middle part without using a tool and without any particular knowledge or visual inspection, characterised in that one of the ends of the wristlet is attached to a plate including two pairs of catches, and co-operating with two pairs of grooves provided in lateral faces of the horns.

As a result of these features, the user can easily detach or attach the wristlet to a watchcase by inserting the catches into the grooves with which they are associated and wedging them on the bottom of said grooves.

Another advantage of the present attaching device lies in the fact that the points of connection of the wristlet to the watchcase are multiplied by two, providing fast and reliable attachment.

A further advantage of the present attaching device lies in the fact that it may be used without discrimination with flexible straps, for example made of leather or fabric, and with metal link bracelets.

According to one feature of the invention, each pair of grooves includes a rectilinear groove and a curved groove having a rectilinear insertion portion extended by a return portion.

According to a preferred embodiment of the invention, the catches are arranged respectively along the longitudinal edges of said plate and the grooves are arranged on the lateral walls of the horns facing each other.

Other advantages and features of the invention will appear more clearly upon reading the following description of an embodiment of the invention given solely by way of illustrative and non-limiting example, said description being made with reference to the drawings in which.

Figure 1:
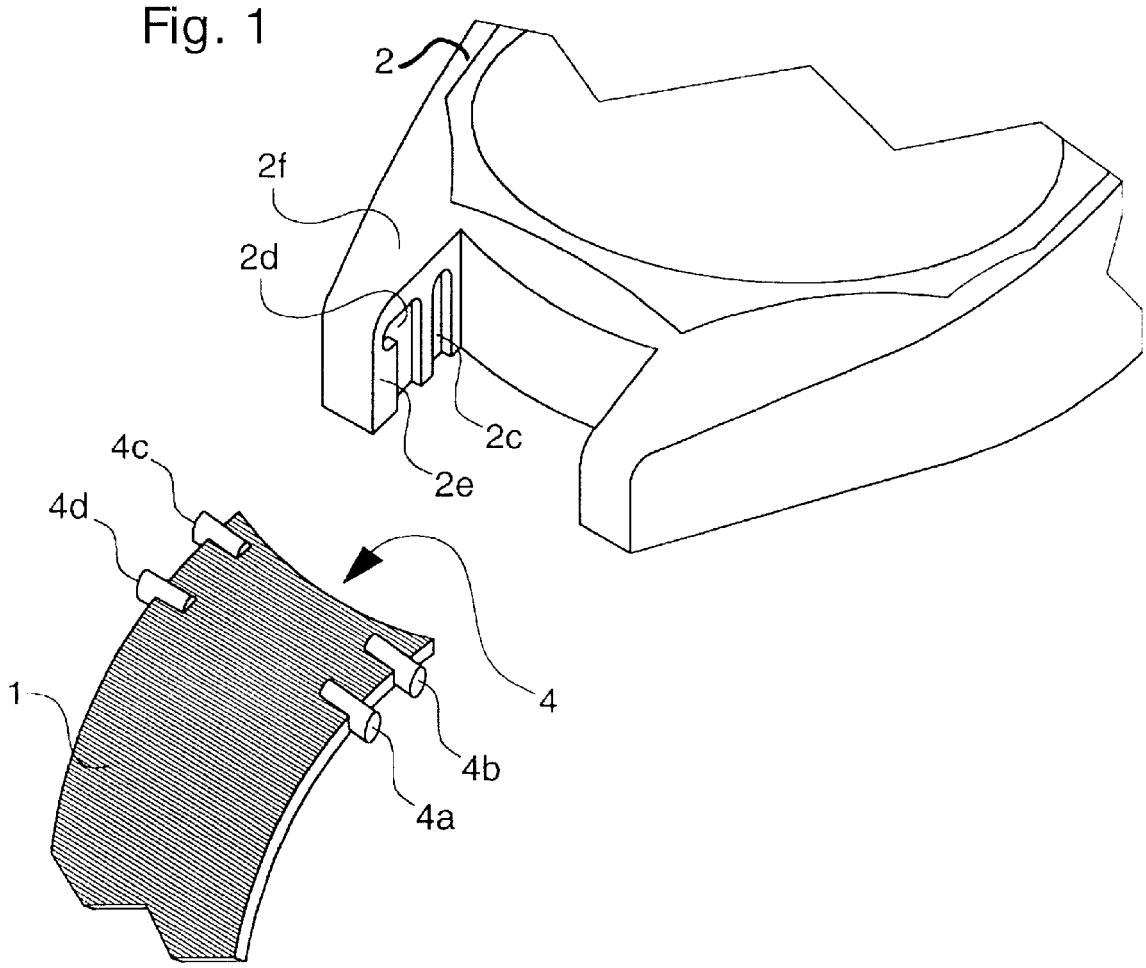
FIG. 1 is a perspective view of the attachment device according to the invention.
Figure 2:
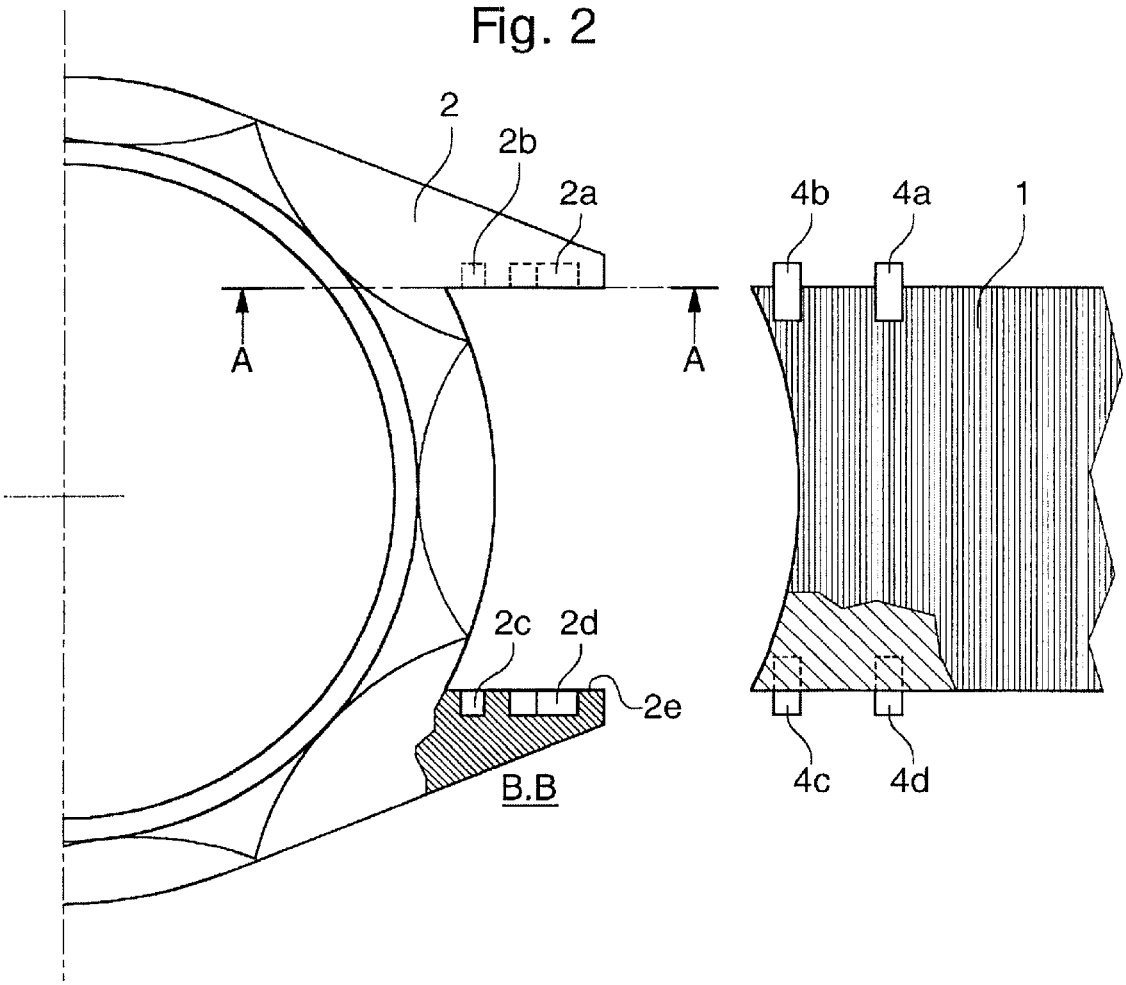
FIGS. 2 and 3 are partial cross-sections showing the shapes of the grooves arranged in the device of the invention.

FIG. 1 is a partial perspective view of a watchcase including a middle part 2 and one end of a wristlet 1 intended to be attached in a hinged manner to middle part 2 using the device according to the invention. Middle part 2 includes two pairs of attachment horns 2*e* for wristlet 1, a single pair of said horns 2*e* being shown in FIG. 1. The two pairs of horns 2*e* are placed in a conventional manner on opposite sides of middle part 2, at 12 o'clock and 6 o'clock. Within the context of the invention, "horns" shall be understood to mean any element of any shape used to attach wristlet 1 to the watchcase. These horns 2*e* may match the general shape of middle part 2, but not necessarily. It will be noted that attachment elements which are barely fastened to middle part 2, or not attached to the middle part at all, or which are added onto the watchcase, are also included in this general definition of "horns".

Figure 3:
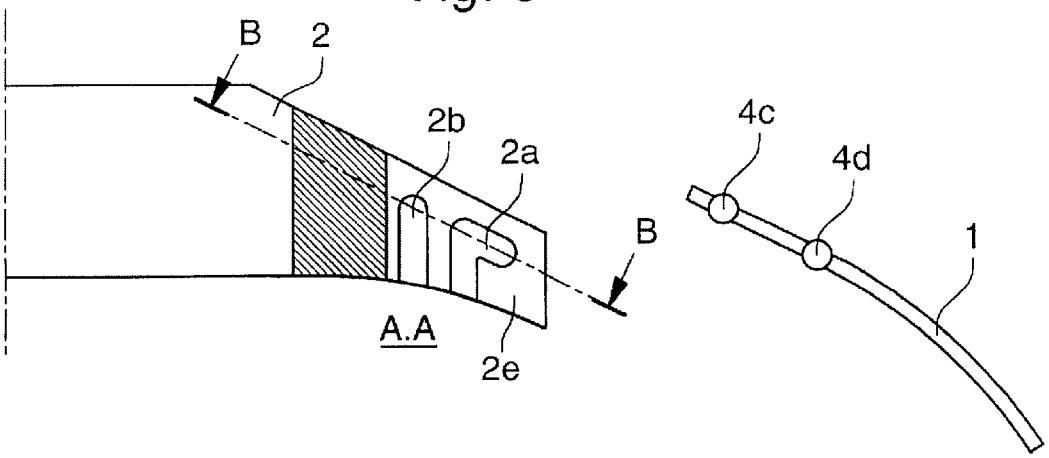

According to this new invention, the holes within horns 2*e* are replaced by two pairs of grooves 2*a*, 2*b* and 2*c*, 2*d*. Grooves 2*b* and 2*c* are straight/rectilinear and vertical, while grooves 2*a* and 2*d* are curved, thus allowing wristlet 1 to be guided until it is wedged. Curved grooves 2*a*, 2*d* have a rectilinear insertion portion extended by a return portion. Rectilinear grooves 2*b*, 2*c* are proximal and curved grooves 2*a* and 2*d* are distal relative to middle part 2. As is shown particularly clearly in FIG. 3, the return portions extend towards the exterior of middle part 2 and the rectilinear insertion portion and the return portion preferably form an acute angle with each other, typically of the order of 45°.

According to the invention, wristlet 1 includes a plate 4, preferably rigid and slightly curved, matching the shape of the wrist and fitted with four catches 1*a*, 1*b*, 1*c* and 1*d* which will be inserted in grooves 2*a*, 2*b*, 2*c* and 2*d* arranged within horns 2*e*, more precisely on the lateral walls of said horns 2*e* facing each other. Catches 1*a*, 1*b*, 1*c* and 1*d* are preferably arranged at the free end of plate 4 and are disposed respectively along the external longitudinal edges of said plate.

Said catches 1*a*, 1*b*, 1*c* and 1*d* can be made industrially in the form of through pins, catches welded or set on plate 4 or attached thereto by any other means, or they may also form an integral part of plate 4. Plate 4 may also be perforated, grooved or indented to facilitate the fitting of any type of wristlet (made of leather, metal, plastic, fabric, rubber, etc.). Since plate 4 is identical on each side of middle part 2, it is thus possible to reverse each half wristlet in order to satisfy the requirements of right-handed and left-handed users. Since plates 4 should preferably be rigid, the use of any material allowing this may be envisaged.

Figure 4:
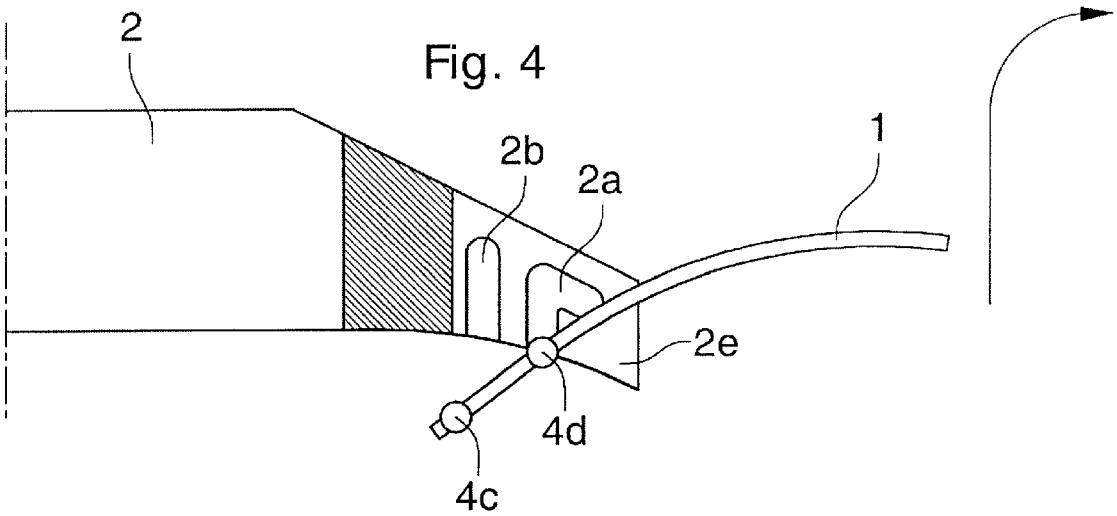
FIGS. 4, 5 and 6 show respectively in order, the relative positions of the catches in the grooves during assembly of the wristlet to a watchcase using an attachment device according to the invention.
Figure 5:
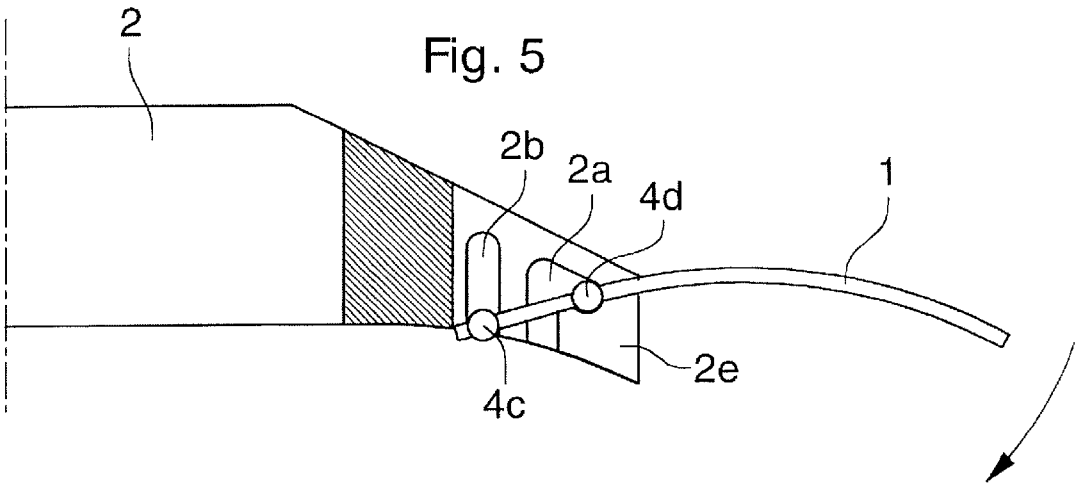
Figure 6:
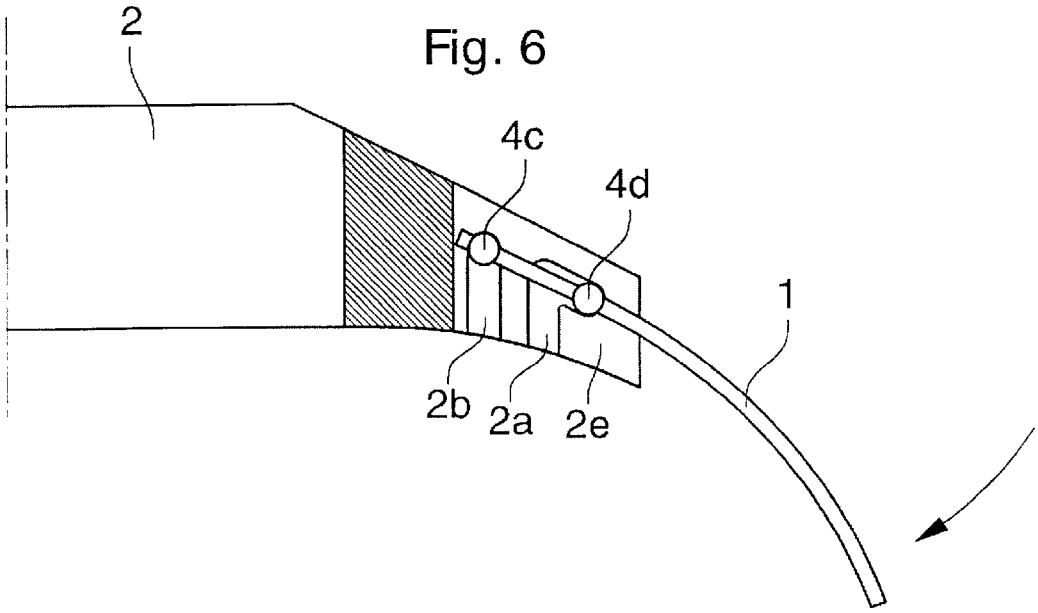

With reference to the drawings, for the operation of this new invention, it is sufficient to place plate 4 between horns 2*e* of middle part 2, to slide catches 1*d* and 1*a* into grooves 2*a* and 2*d*, then to pull plate 4 upwards and to the right as is shown in FIG. 4, by rocking plate 4 downwards, catches 1*a* and 1*d* then coming automatically to the bottom of grooves 2*a* and 2*d* while lifting catches 1*b* and 1*c* into grooves 2*b* and 2*c* as is shown in FIG. 5. By continuing the same movement, catches 1*b*, 1*c* automatically rise and abut the bottom of grooves 2*b*, 2*c* thereby instantaneously attaching plate 4, and thus wristlet 1, to middle part 2, and thus to the watch, without any securing device, as is shown in FIG. 6. The final stage of fastening comprises attaching the watch to the wrist.

In order to remove plate 4 from the watch, or in other words, from middle part 2, it is sufficient to perform the manoeuvre in reverse.

According to an alternative embodiment of the invention which is not shown, a stop in the form of a ball for example biased by a spring, a bump or any other mechanical means may be added onto middle part 2 or plate 4.

The shape of middle part 1, horns 2*e* and plate 4 and the proportions thereof are obviously not limiting.

The invention provides:

rapid, secure and easy attachment of a wristlet to a watch without using a tool;

stability of the wristwatch on the wrist without gripping the latter excessively;

twice the normal security and robustness (four connection points instead of two generally).

What is claimed is:

1. Device for attaching a wristlet (1) to a watchcase including a middle part (2) fitted with a pair of attachment horns (2*e*) for the wristlet (1), said device allowing instantaneous attaching and detaching of a strand of the wristlet (1) to the middle part (2) without using a tool and without any particular knowledge or visual inspection, characterised in that one of the ends of the wristlet (1) is attached to a plate (4) including two pairs of catches (1*a*, 1*b*, 1*c*, 1*d*), and co-operating with two pairs of grooves (2*a*, 2*b*, 2*c*, 2*d*) provided in lateral faces of the horns (2*e*).

2. Attachment device according to claim 1, characterised in that each pair of grooves (2*a*, 2*b*, 2*c*, 2*d*) includes a rectilinear groove and a curved groove having a rectilinear insertion portion extended by a return portion.

3. Attachment device according to claim 2, characterised in that the rectilinear groove is proximal and the curved groove is distal relative to the middle part (2).

4. Attachment device according to claim 2, characterised in that the return extends towards the exterior of the middle part (2).

5. Attachment device according to claim 2, characterised in that the rectilinear insertion portion and the return portion form an acute angle.

6. Attachment device according to claim 1, characterised in that the pairs of catches (1*a*, 1*b*, 1*c*, 1*d*) are arranged at the free end of the plate (4).

7. Attachment device according to claim 1, characterised in that the catches are disposed respectively along the external longitudinal edges of said plate and in that the grooves (2*a*, 2*b*, 2*c*, 2*d*) are arranged on the lateral walls of the horns (2*e*) facing each other.

8. Attachment device according to claim 1, characterised in that the plate (4) is rigid and curved.

9. Attachment device according to any of the preceding claims, characterised in that a stop in the form of a ball is arranged on the middle part (2) or the plate (4) to hold said plate in position.

10. Attachment device according to claim 3, characterized in that the return extends towards the exterior of the middle part (2).

11. Attachment device according to claim 3, characterized in that the rectilinear insertion portion and the return portion form an acute angle.

12. Attachment device according to claim 2, characterized in that the pairs of catches (1*a*, 1*b*, 1*c*, 1*d*) are arranged at the free end of the plate (4).

13. Attachment device according to claim 3, characterized in that the pairs of catches (1*a*, 1*b*, 1*c*, 1*d*) are arranged at the free end of the plate (4).

14. Attachment device according to claim 4, characterized in that the pairs of catches (1*a*, 1*b*, 1*c*, 1*d*) are arranged at the free end of the plate (4).

15. Attachment device according to claim 5, characterized in that the pairs of catches (1*a*, 1*b*, 1*c*, 1*d*) are arranged at the free end of the plate (4).

16. Attachment device according to claim 2, characterized in that the catches are disposed respectively along the external longitudinal edges of said plate and in that the grooves (2*a*, 2*b*, 2*c*, 2*d*) are arranged on the lateral walls of the horns (2*e*) facing each other.

17. Attachment device according to claim 6, characterized in that the catches are disposed respectively along the external longitudinal edges of said plate and in that the grooves (2*a*, 2*b*, 2*c*, 2*d*) are arranged on the lateral walls of the horns (2*e*) facing each other.

18. Attachment device according to claim 2, characterized in that the plate (4) is rigid and curved.

19. Attachment device according to claim 3, characterized in that the plate (4) is rigid and curved.

20. Attachment device according to claim 2, characterized in that a stop in the form of a ball is arranged on the middle part (12) or the plate (4) to hold said plate in position.

* * * * *